US006027286A

United States Patent [19]

Pollack

[11] Patent Number: 6,027,286

[45] Date of Patent: Feb. 22, 2000

[54] OFFSHORE SPAR PRODUCTION SYSTEM AND METHOD FOR CREATING A CONTROLLED TILT OF THE CAISSON AXIS

[75] Inventor: Jack Pollack, Calabasas Hills, Calif.

[73] Assignee: Imodco, Inc., Houston, Tex.

[21] Appl. No.: 08/879,261

[22] Filed: Jun. 19, 1997

[51] Int. Cl.[7] ..... E02B 11/38; E02D 23/00

[52] U.S. Cl. ..... 405/195.1; 405/203; 405/223.1; 405/224; 405/224.2; 175/7; 166/354; 166/367

[58] Field of Search ..... 405/195.1, 203, 405/204, 223, 223.1, 224, 224.1, 224.2, 224.3, 224.4; 114/144, 230, 256, 264, 293; 166/350, 354, 358, 359, 367; 175/7, 8

[56] References Cited

U.S. PATENT DOCUMENTS

| | | | |
|---|---|---|---|
| 3,111,926 | 11/1963 | Shatto . | |
| 3,360,810 | 1/1968 | Busking | 114/256 X |
| 3,535,883 | 10/1970 | Manning . | |
| 3,580,207 | 5/1971 | Pangalila | 114/144 B |
| 3,602,174 | 8/1971 | Gorman . | |
| 3,712,260 | 1/1973 | Mott et al. . | |
| 3,778,854 | 12/1973 | Chow . | |
| 4,170,186 | 10/1979 | Shaw . | |
| 4,280,430 | 7/1981 | Wilson et al. . | |
| 4,576,521 | 3/1986 | Conrad . | |
| 4,604,961 | 8/1986 | Ortloff et al. . | |
| 4,666,339 | 5/1987 | Pollack | 405/224 X |
| 4,702,321 | 10/1987 | Horton | 166/350 |
| 4,797,033 | 1/1989 | Pollack | 405/224 X |
| 4,802,432 | 2/1989 | Poldervaart et al. . | |
| 4,906,139 | 3/1990 | Chiu et al. | 405/224 |
| 4,936,710 | 6/1990 | Petty et al. | 405/224 |
| 5,706,897 | 1/1998 | Horton, III | 405/195.1 X |

FOREIGN PATENT DOCUMENTS

| | | | |
|---|---|---|---|
| 2106466 | 4/1983 | United Kingdom | 114/293 |

*Primary Examiner*—David Bagnell
*Assistant Examiner*—Jong-Suk Lee
*Attorney, Agent, or Firm*—Freilich, Hornbaker & Rosen

[57] ABSTRACT

An offshore system is provided of the type that includes riser pipes (30) extending up from the seafloor (44) to a tall and narrow caisson (12) at the sea surface, with the caisson moored by mooring lines (34) extending to the seafloor and anchored thereat, which minimizes bending of the upper portion of the riser pipes when the caisson drifts in severe weather. Although the caisson has a Ballasted lower end and buoyant upper end to keep its axis (20) vertical, a device is provided for applying a horizontal force (54) to a location along the caisson that is vertically spaced from the upper ends of the mooring lines, to tilt the caisson so the axis of the caisson is parallel to portions (82) of the riser pipes lying immediately below the caisson. In one arrangement, a second set of mooring lines (60) is provided, that have upper ends coupled to second locations (64) along the caisson that are vertically spaced from the upper ends of the first mooring lines. Also, a motor driven device (70) is provided for pulling on selected ones of the lines to tilt the caisson. In another arrangement, largely horizontal force transmitting members (132) extend from a lower portion of the caisson to a location (136) along a single set of mooring lines (126). In still another system, thrusters (152, 154) are used to push at locations along the caisson to tilt it.

15 Claims, 4 Drawing Sheets

34A
56
12A
50
82A
20B
R
52
30B
12B
54
50
80
53
12

N
S
12B
12A
70
82A
34B
60B
30A
20
45
38
36
16
12
18
64
62
82
30
46
32
14
34
34A
60
60A
44
10
40
42

120
122A
134A
134B
130
122
136
134
138
140
124
126
132

140
142
141
136
134

164
162
156A
160
171
166
154
156
172
152
150
170
168

153
156
174
152
173
170

OFFSHORE SPAR PRODUCTION SYSTEM AND METHOD FOR CREATING A CONTROLLED TILT OF THE CAISSON AXIS

BACKGROUND OF THE INVENTION

Spar systems are used in deep seas of at least about 500 meters depth and usually more, to produce hydrocarbons from undersea wells, as well as to drill the wells and store produced oil. Such systems have a tall and narrow caisson extending down from the sea surface by perhaps one or two hundred meters and riser pipes that extend down from the lower portion of the caisson to the seafloor. Taut mooring lines extend at an incline from the caisson to anchors at the seafloor to limit drift. The tall and narrow caisson is subject to only moderate forces from winds, currents, and waves that cause it to drift from a quiescent position wherein it lies directly over the lower ends of the riser pipes.

Although caisson drift is limited, it still can be substantial in severe weather. When the caisson drifts, its axis remains largely vertical due to ballast at its bottom and buoyancy at its top, and the upper portions of the riser pipes which lie within the caisson also extend vertically. As a result, when the caisson drifts so the lower portions of the riser pipes extend at an incline while upper portions extend vertically, the riser pipes undergo a bend within a height if a few meters at the lower portion of the caisson. Such bending about a relatively small radius of curvature, can reduce the lives of the riser pipes. A system that minimized bending of riser pipes at the bottom of the caisson, when the caisson drifts, would be of value.

SUMMARY OF THE INVENTION

In accordance with one embodiment of the present invention, a spar system and operating method are provided, which minimize bending of upper portions of riser pipes that extend through guides at the bottom of the caisson, when the caisson drifts. Bending of the riser pipes thereat is minimized by applying forces to tilt the caisson so its axis is substantially parallel to the portions of the riser pipes that lie immediately below the caisson. Such tilt is achieved by applying horizontal forces to the caisson at vertically spaced locations.

In one system where a caisson is moored by a first set of taut mooring lines extending to the seafloor, applicant adds a second set of taut mooring lines whose upper ends are vertically spaced from the upper ends of the first set. A motor driven device is coupled to the upper ends of the second set of mooring lines, to pull selected ones of the lines, to thereby produce a horizontal component of force that tilts the caisson.

In another system, largely horizontal force transmitting members (which may be flexible lines) extend from locations on the caisson below the upper ends of the mooring lines, to positions along a single set of mooring lines. A motor-driven device on the caisson can pull the force transmitting members (or even push them) to create horizontal forces that tilt the caisson. Opposite force-transmitting members are preferably connected together, so the motor-driven device applies only a differential force. In still another system, thrusters are used to tilt the caisson.

The motor-driven devices can even be used to reduce caisson drift.

The novel features of the invention are set forth with particularity in the appended claims. The invention will be best understood from the following description when read in conjunction with the accompanying drawings.

DESCRIPTION OF THE PREFERRED EMBODIMENTS

Figure 1:
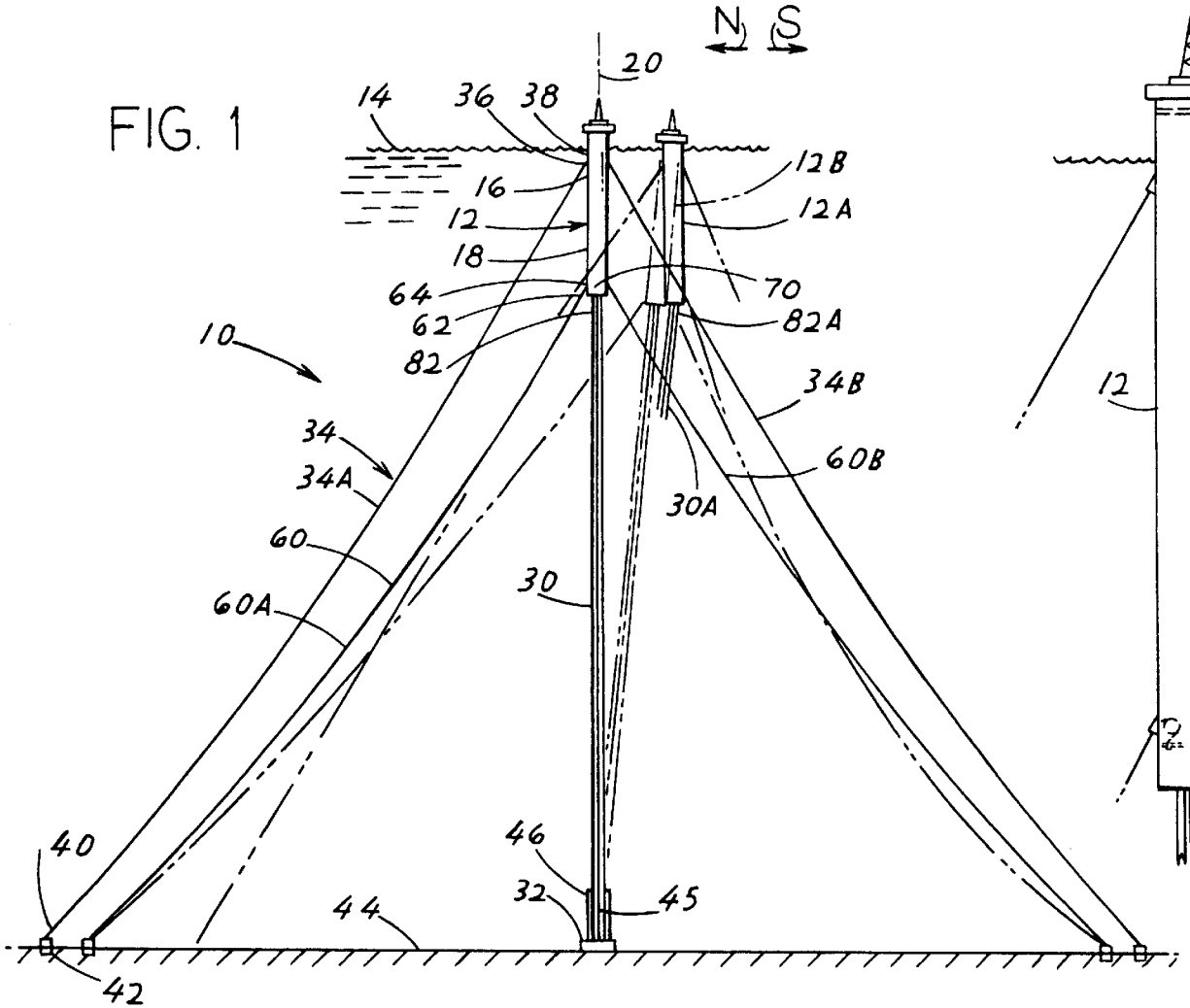
FIG. 1 is a side elevation view showing a spar system of one embodiment of the invention, with the spar system shown in solid lines in its quiescent position, in solid lines in its drifted position, and in phantom lines in its drifted-and-tilted position.

FIG. 1 illustrates a spar system 10 that includes a tall and narrow caisson 12 that floats at the sea surface 14. The caisson has upper and lower portions 16, 18 and has a primarily vertical axis 20. Riser pipes 30 extend up from a base 32 at the seafloor 44 to the caisson, and carry hydrocarbons from seafloor wells to the caisson. The caisson transfers the hydrocarbons to tankers or through conduits to other facilities and may store some oil prior to its transfer. A first set of mooring lines 34, which includes lines 34A, 34B, have upper ends 36 coupled at first locations 38 to the caisson, and have lower ends 40 coupled to anchors 42 at the seafloor. The mooring lines 34 extend in tight catenary curves, to limit drift of the caisson.

The caisson has buoyancy chambers in its upper portion and ballast chambers in its lower portion, to keep its axis 20 vertical. As a result, when the caisson drifts, as to the position 12A as a result of large waves, currents, and winds, especially in severe weather, the caisson tends to remain in an orientation wherein its axis 20 remains substantially vertical (usually within 2° of the vertical orientation it assumes in a quiescent state). As a result of such drift, the riser pipes at 30A are bent at locations where their upper ends at 82A enter the lower end of the caisson. Since the riser pipes 30 extend by at least a few hundred meters before reaching the caisson, bending of the lower portion 45 of the riser pipes can be controlled by a stress joint 46 at the lower pipe portions that limits the radius of curvature of bending to minimize harm. However, upper portions of the riser pipes that enter the drifted caisson at 12A may have to undergo relatively sharp bending, which could damage them.

Figure 2:
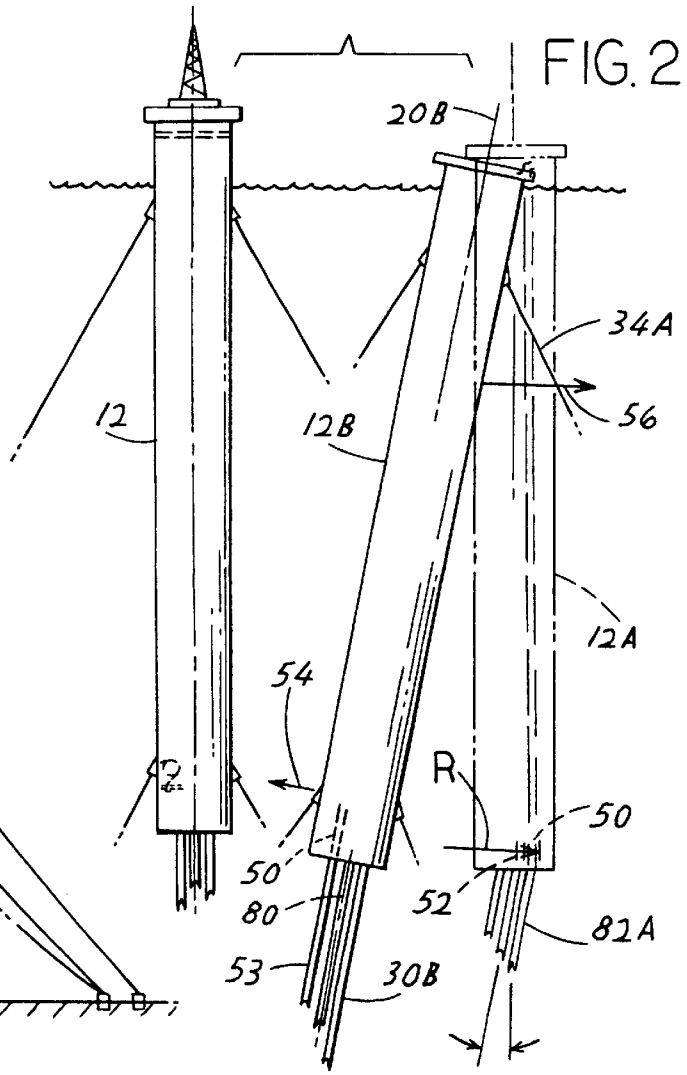
FIG. 2 is a side elevation view of the caisson in the positions of FIG. 1, but with the caisson in its quiescent position and in its drifted-and-tilted position shown in solid lines and with the caisson in its drifted but untilted position shown in phantom lines.

FIG. 2 shows riser pipe upper ends at 80A with guided portions 50 that are guided in bending by guides 52 lying at the lower portion of the caisson. The radius of curvature R of pipe bending thereat is relatively small, such as perhaps twenty meters for a pipe of a diameter of 0.3 meters. Such relatively sharp bending of the riser pipes can lead to damage and a reduced life for them, as by the development of hairline cracks that would lead to fatigue failure.

In accordance with the present invention, applicant minimizes bending of upper portions of the riser pipes by tilting the caisson when it drifts, as by tilting it to the orientation shown at 12B. Such tilting is carried out so the tilted axis 20B of the tilted caisson is substantially parallel to riser pipe portions 53 (the angle between them is no more than 6° and preferably no more than 3°) that lie immediately below (within 5 meters) the lower end of the caisson. Such tilting is achieved by applying a horizontal force such as indicated at 54, to tilt the riser. In order to tilt the riser, it is necessary to apply a torque to counter the tendency of the riser to remain vertical, so forces must be applied at vertically spaced locations on the caisson. In FIG. 2, it is assumed that an additional force applied at 54 is countered by a force applied at 56 at the upper portion of the riser by currents that cause initial caisson drift.

Applicant can minimize bending of upper portions of the riser pipes by reducing the amount of drift, and/or by tilting the caisson. When the amount of drift is reduced, this also reduces bending at the lower portions 45 of the riser pipes.

FIG. 1 shows that the spar system 10 comprises a second set of mooring lines 60 that includes second mooring lines 60A and 60B. The upper ends 62 of the second mooring lines are connected to the caisson at second locations 64 that are vertically spaced from the first locations 38 where the first mooring lines 34 are coupled to the caisson. In addition, at least one motor operated device 70 is coupled to the upper end 62 of at least some of the second mooring lines 60 to controllably pull them.

Figure 3:
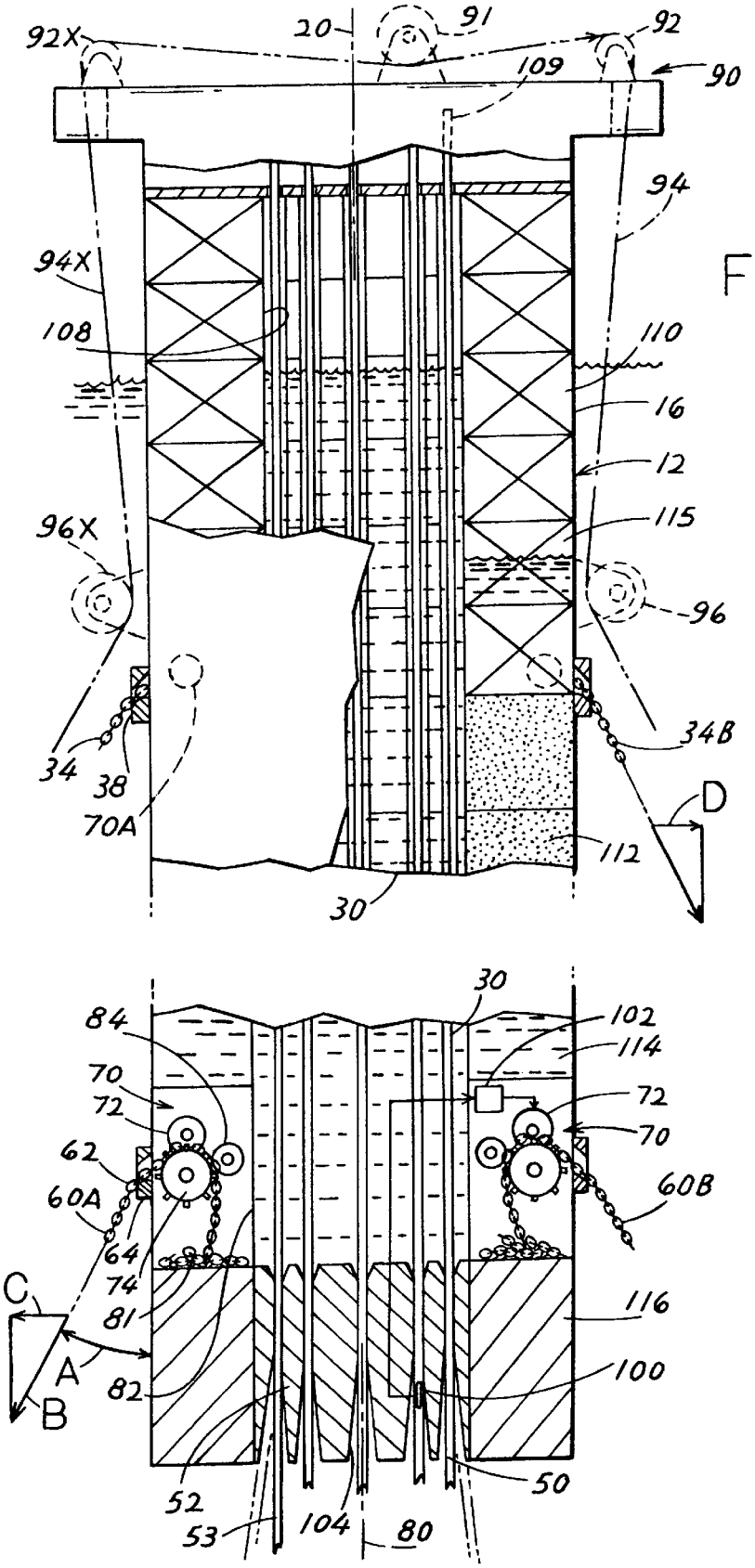
FIG. 3 is a partial sectional view of the caisson of FIG. 2.

FIG. 3 shows a pair of motor operated devices 70 that are each coupled to the upper end 62 of a one of the second mooring members 60A, 60B. The particular devices 70 each includes a motor 72 connected to a sprocket wheel 74 to turn it to pull in and payout a mooring line such as 60A. The upper portion of the particular second mooring line 60A is a chain, and a length of the chain is held at 81 in a chain locker 82 in the caisson. An idler 84 keeps the second mooring line engaged with the sprocket wheel. A similar construction is shown for the device coupled to the other second mooring line 60B. In the example shown, each mooring line extends at an angle A of about 30° from the vertical in the quiescent condition of the system. A given increase in tension B in the chain results in a horizontal force component C that is one-half of B (for A=30°). Although there is tension in both lines 60A and 60B, an increase in tension in one of the lines results in a corresponding increased horizontal component of force such as C, which tends to move the lower portion of the caisson in one direction, resulting in tilt of the caisson (when an opposite force is applied to an upper location). As the caisson tilts it also moves, resulting in increased tension on mooring line 34B and a force D that counters force C and that results in a torque that counters the tendency of the caisson to return its axis 20 to the vertical. It is noted that the tension in the other mooring lines also changes. Thus, applicant is able to tilt the caisson 12 to make parallel, the axis 20 of the caisson with the axis 80 of the riser pipes 30 at riser pipe locations 53 that lie immediately below the guides 52. This is accomplished by applying an increased force (horizontal component C) to one location 64 that is vertically spaced from locations 38 where sideward movement of the caisson is resisted (as by force D). Further increased tension in lines 34, 60 reduces drift.

It is possible to use devices 70 at both the upper and lower locations 38, 64, or either one of them, to tilt the caisson. By providing devices 70A at the upper locations 38, it is possible to greatly reduce or even eliminate caisson drift in normal weather, so that less or no caisson tilt occurs. However, much more force is generally required to counter caisson drift in severe weather, than to merely tilt the drifted caisson, so tilt is generally preferred in severe weather. However, as discussed above, even if drift is not eliminating it, reducing drift is useful.

FIG. 3 shows another motor-operated device 90 which could be used to increase tension in one of the mooring lines 94. This device 90 includes a motor operated winch 91 that can wind up or payout a line 94 (e.g. a cable) that extends about pulley 92 and about an underwater pulley 96 and from there at an incline to the seafloor. The line 94 merges with an opposite line 94X that extends around pulleys 92X, 96X and from there to the seafloor. All mooring lines can be variably tensioned in this manner.

In FIG. 3, applicant shows a sensor 100 on one of the riser pipes 30, with the sensor 100 positioned at the riser pipe location that undergoes bending when the caisson drifts but does not tilt. An electrical output from the sensor 100 can be used to detect when riser pipe bending exceeds a predetermined limit such as three degrees from parallelism with the caisson axis 20, to operate a control circuit 102 that energizes the motor 72 of a motor-driven device 70. The device 70 very slowly tightens one of the chains to tilt the caisson and reduce misalignment (deviation from parallelism of the two axes 20, 80) to limit the deviation to a predetermined amount such as three degrees. Instead of a sensor 100 on a pipe, a sensor can be placed on a guide, as at 104, to sense a bent riser pipe.

The angle between parallelism of the caisson axis 20 and the riser pipe portions 53 lying immediately below the caisson can be determined in several ways. One way is to mount an inclinometer on the caisson deck and on the riser pipe portion and indicate the difference in inclination. Another way is by a DGPS (Digital Global Positioning System) and an inclinometer on the deck, with a lookup table to indicate the angle.

The caisson shown in FIG. 3 is hollow and forms water-containing passages 108 of the riser pipes. The top ends 109 of the riser pipes are connected to prior art tensioning device that pull them upward, and are connected to processing and/or storage equipment. The caisson has buoyancy chambers 110 that can contain air, oil chambers 112 that can contain stored oil, water chambers 114 that can contain water, and a ballast chamber 116 that contains a high density material such as scrap steel. The amount of water or air in the water chamber 114 can be varied. The riser pipes 30 are kept in tension by caisson buoyancy and by tensioning devices. In the particular system of FIG. 1, the caisson 12 has a height of 150 meters and a diameter of 10 meters, and lies in a sea location having a depth of one-thousand meters.

Figure 4A:
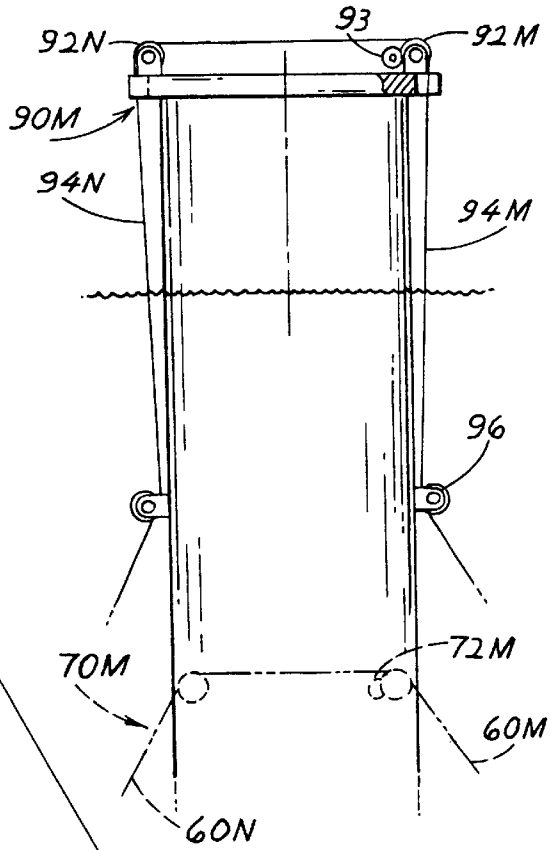
FIG. 4A is a side elevation view of a spar system modified from that of FIG. 1.
Figure 4:
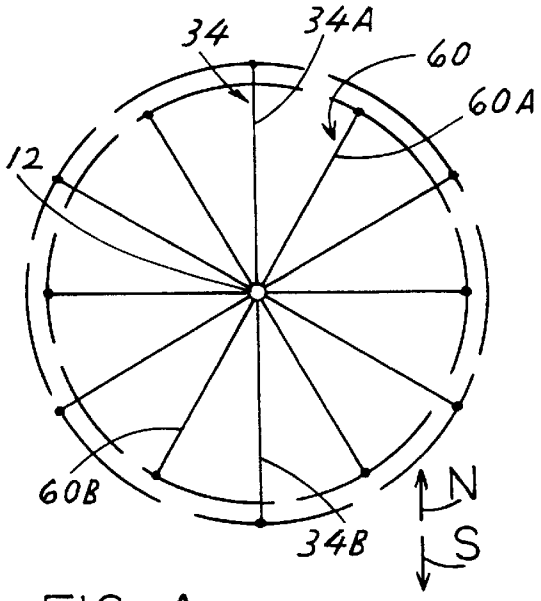
FIG. 4 is a plan view of the system of FIG. 1 in its quiescent position.

FIG. 4 shows that the caisson 12 is moored by six mooring lines 34 of the first set and six lines 60 of the second set. The mooring lines extend in different headings with North and South headings indicated by N and S. Of course, the selected one (or more) of the second mooring lines 60 whose tension is to be increased, is determined by the direction of caisson drift. Several sensors on the guided portions 50 of the pipes can be used to control tilt. Vertically offset mooring lines 34, 60 can extend in the same headings and lie one under the other.

FIG. 4A shows a modified system 90M where a pair of primarily opposite mooring lines 94M, 94N are connected together. When one line 94M is shortened, the other 94N is lengthened, to achieve differential tension. Only one of the two pulleys 92M, 92N need to be driven, and the motor 93 merely needs to produce a difference in mooring line tension, rather than increase an already high tension in one line. Also, the motor lies above or close (within about one meter) of the water line so it can be more easily serviced. The system 70M is similar, with two mooring lines 60M, 60N connected and a motor 72M having to apply only differential mooring line tension. The system 70M can have its mooring lines extend to the top of the caisson as for lines 94M, 94N.

Figures 5, 6, 7, 8:
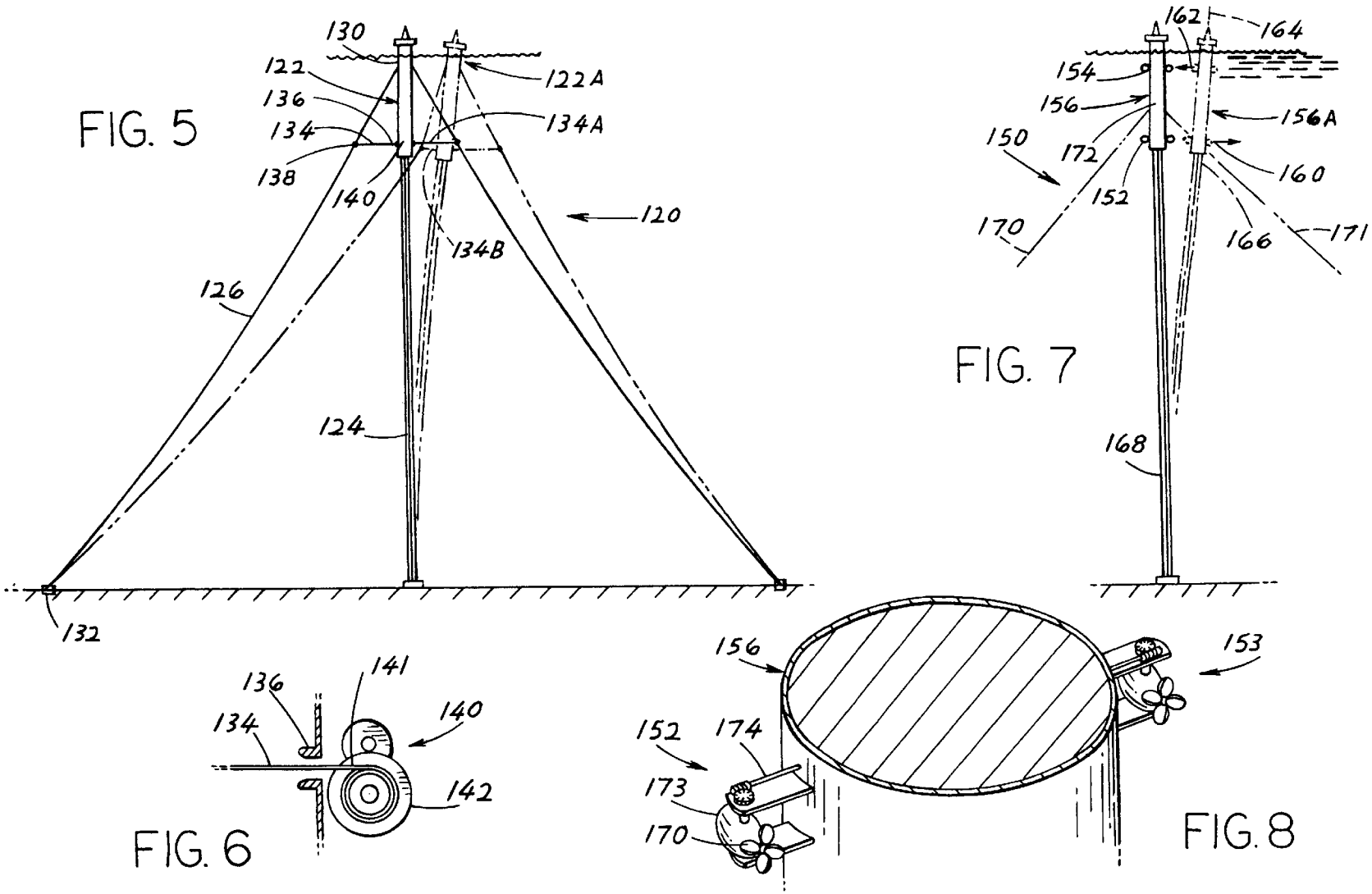
FIG. 5 is a side elevation view of a spar system of another embodiment of the invention, with the caisson shown in solid lines in its quiescent position and shown in phantom lines in its drifted-and-tilted position.
FIG. 6 is a simplified sectional view showing a motor-operated drive that can be used with the caisson of FIG. 5.
FIG. 7 is a side elevation view of a spar system constructed in accordance with another embodiment of the invention.
FIG. 8 is a simplified isometric and sectional view of the caisson of FIG. 7, showing the thrusters thereof.

FIG. 5 illustrates another spar system 120 that includes a caisson 122 and riser pipes 124 extending up from the seafloor to the caisson. The caisson is moored by a single set of mooring lines 126 that extend from upper locations 130 on the caisson to anchors 132 on the seafloor. The mooring lines are taut, in that they do not extend more than a meter on the seafloor, although they must have some curvature if they have an average specific gravity of more than one. In order to tilt the caisson, applicant provides force transmitting members 134 that extend largely horizontally (less than 60° from the horizontal) from locations 136 on the caisson that are below the upper locations 130, to positions 138 lying along the mooring lines 126. A motor-operated device 140 connected to the proximal end 141 of a member 134, which is the end lying at the caisson, can shorten or lengthen the member 134 to thereby apply a changed horizontal force to the lower end of the caisson.

Figure 6A:
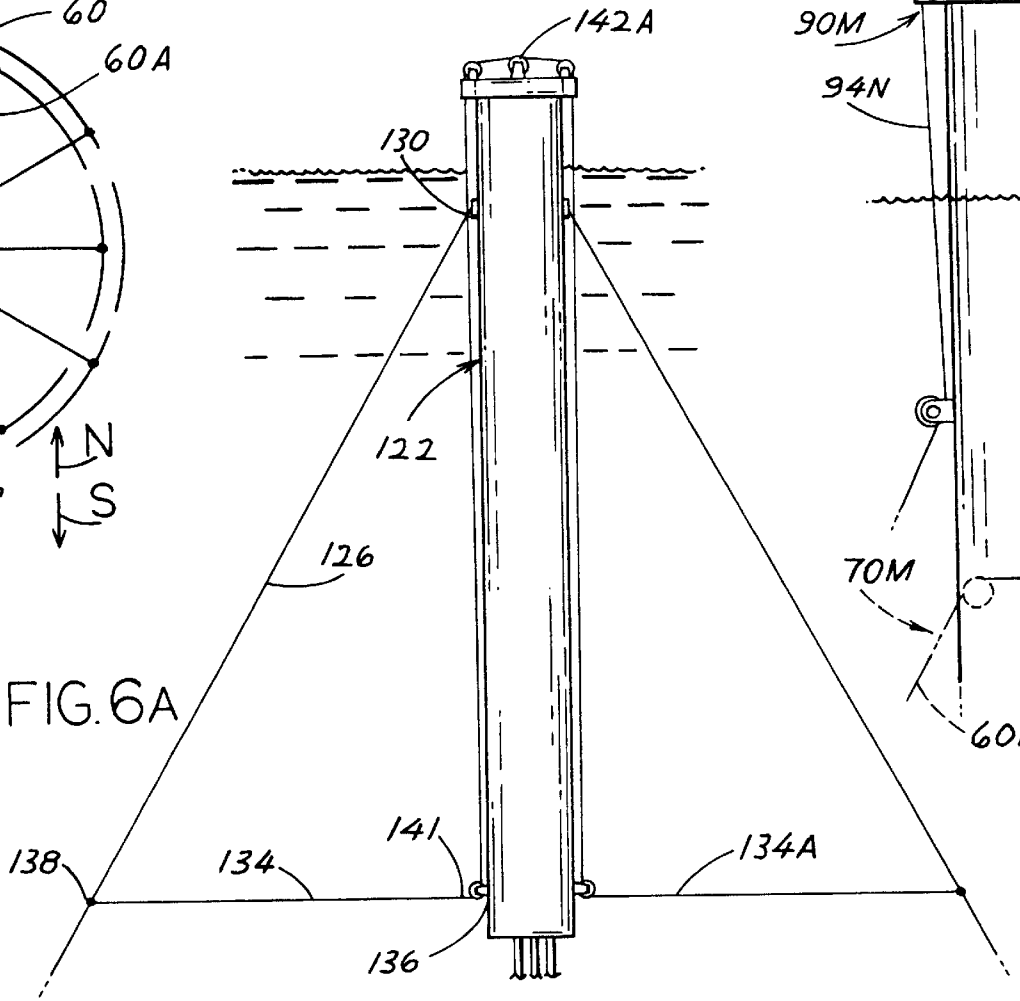
FIG. 6A is a simplified side view showing another motor-operated drive that can be used with the caisson of FIG. 5.

FIG. 6 shows an example of a device 140 for pulling the member 134. The device 140 includes a windup reel 142 that can windup the member 134 to increase tension on it and pull the lower end of the caisson in a selected direction. The particular member 134 shown is a cable that can be readily wound on and off a reel. Since the force transmitting member 134 is relatively short, it could instead be a stiff member that can withstand compression, and which can be pushed towards one of the mooring lines to push the lower end of the caisson in the opposite directions. In all such cases the member 134 can be referred to as a force transmitting member. The opposite force transmitting members 134, 134A preferably extend to a height near or above the waterline and are connected together, as shown for lines 94M, 94N in FIG. 4A. FIG. 6A shows another example, where opposite force transmitting members such as 134, 134A which extend primarily in opposite headings from the caisson lower locations, are both connected to a winch drive 142A that can increase tension in one member while decreasing it in the opposite member.

FIG. 5 shows the caisson after it has drifted and been tilted to the position 122A. One of the members at 134B has been shortened to cause the tilt. The caisson at 122A lies closer to its quiescent position than if no tilt had been induced. When the caisson drifts, the upper and lower thrusters are energized to move corresponding upper and lower caisson locations in opposite directions to tilt the caisson. In FIG. 7, forces 160, 162 are applied by the thrusters to tilt the caisson so its axis at 164 is aligned with locations 166 of the riser pipes 168 that lie immediately below the caisson. FIG. 8 shows an example of thrusters 152, 153 mounted on the caisson 156. Each thruster has propellers 170 driven by a motor 173. The motor and propeller can slowly be turned to different headings by a worm drive at the end of a control rod 174, to push the lower portion of the caisson in a selected direction to tilt the caisson. In FIG. 7, applicant has shown mooring lines 170, 171 in phantom lines that pass close to the centroid 172 of likely current forces. Such mooring lines 170, 171 can be used instead of one of the thruster devices such as 154, so that only one thruster device 152 is required. The thrusters can be used to prevent more than a few degrees of caisson drift so tilting is not required, but much greater thrust capacity is required to prevent drift than tilt.

Instead o thrusters that have propellers and that can be turned, thrust forces can be obtained by nozzles that are spaced about the caisson and that form thrusters. Water pumped by pumps near the top of the caisson is forced through selected nozzles, creating forces to position the caisson. A disadvantage of thrusters is that they must be continually energized to apply a constant force, compared to line tensioning devices that must be energized only to increase line tension and which thereafter can be braked to maintain tension.

It is possible to lower the upper ends of the lines 170, 171 so they converge at a location a plurality of meters (preferably at least 5 meters) below the centroid 172 of likely current forces. When the caisson drifts, as to 156A, one line 170 extending away from the drift direction undergoes an increase in tension (while the other 171 undergoes a decrease in tension). This results in a torque tending to tilt the caisson as shown. The amount of tilt can be controlled by adjusting the uprighting torque level that the caisson applies when its axis is tilted from the vertical. The uprighting torque level may be defined as the torque required to tilt the caisson by a given angle such as 1° from a quiescent orientation (wherein its axis is nearly vertical). The uprighting torque level may be increased in FIG. 3 by, for example, increasing the amount of air (and decreasing the amount of water) in an upper chamber such as 115.

Thus, the invention provides a spar system and method for operating it, which enables reduction or elimination of bending of the riser pipes in the lower portion of the caisson when the caisson drifts and/or which prevents substantial caisson drift. This is accomplished by applying forces to the caisson that move or tilt it so the axis of the caisson is substantially parallel (within about three degrees) of the axes of the riser pipes at locations immediately below the caisson. One apparatus for tilting the caisson includes a second set of mooring lines and a motor driven device for increasing the tension in selected ones of the mooring lines. Another system includes a largely horizontal force transmitting member extending from the caisson to a position along a mooring line and a device for increasing tension in a selected one of the force transmitting members. Still another system includes at least one thruster and either another thruster or mooring lines, with the thruster or thrusters operated to move or tilt the caisson when it drifts far.

Although particular embodiments of the invention have been described and illustrated herein, it is recognized that modifications and variations may readily occur to those skilled in the art, and consequently, it is intended that the claims be interpreted to cover such modifications and equivalents.

What is claimed is:

1. In a spar system that includes a tall narrow caisson that is buoyant and that floats at the sea surface and that has upper and lower portions and a primarily vertical caisson axis, and at least one riser pipe that extends up from the sea floor and that has a riser guided portion that is coupled to said caisson lower portion, with said riser pipe having an upper end connected to said caisson upper end portion, where said spar system includes a first set of mooring lines that have upper ends that are coupled to said caisson at first caisson locations with said mooring lines extending in different headings and at downward inclines to the sea floor and having lower ends anchored to the sea floor, and where said riser pipe extends substantially vertically from the sea floor to said caisson in a quiescent position of said caisson, the improvement of apparatus for minimizing bending of said riser pipes when said caisson drifts away from said quiescent position, comprising:

means for creating a controlled tilt from the vertical, of said caisson axis to reduce any angle between said caisson axis and a longitudinal axis of said riser pipe at a location immediately below said caisson.

2. The spar system described in claim 1 wherein:

said means for creating is constructed to apply a controllably variable horizontal component of force to said caisson at a second caisson location that is vertically spaced from said first caisson locations, while said upper ends of said mooring lines continue to be connected to said first caisson locations.

3. The spar system described in claim 2 wherein:

said means for creating includes a set of elongated force transmitting members that have first ends coupled to said caisson at said second locations, with said second locations lying below said first locations, and with said force transmitting members each having opposite second ends that are each connected to a different one of said mooring lines;

motor means for pulling the first end of a selected first one of said force transmitting members, to thereby move the caisson second location to tilt the caisson.

4. The spar system described in claim 3 wherein:

said second ends of said force transmitting members are connected to said mooring lines at locations lying closer to the sea surface than to the seafloor.

5. The spar system described in claim 3 wherein:

said motor means is constructed to pay out the first end of a second one of said force transmitting members as said motor means pulls the first end of said first force transmitting member, where said first and second members extend in primarily opposite headings from said caisson.

6. The spar system described in claim 2 wherein:

said means for creating a horizontal component of force includes a motor driven thruster.

7. The spar system described in claim 1 wherein:

said caisson has a centroid of likely current forces and said mooring line upper ends are vertically spaced from said centroid;

said caisson has a buoyant upper portion and a ballasted lower portion that produce an uprighting torque level that tends to keep said caisson axis vertical, and including means for changing said uprighting torque level.

8. A method for use with a spar system that includes a tall but narrow caisson that floats at the sea surface and that has upper and lower portions and a primarily vertical caisson axis with said lower portion forming a riser guide, and at least one riser pipe that is under tension and that extends upward from a riser pipe lower end that is fixed to the sea floor with said riser pipe having a riser-guided portion that passes through said riser guide and an upper riser pipe end connected to said caisson upper end portion, with said caisson being capable of drifting from a quiescent position wherein said caisson lies substantially vertically over said riser lower ends, comprising:

providing an apparatus for creating a controlled tilt of said caisson axis so said caisson axis is substantially aligned with a portion of said riser pipe that lies immediately below said riser guided portion, to thereby minimize bending of said riser pipe.

9. The method described in claim 8 wherein:

said step of providing an apparatus for creating includes applying forces with horizontal directional components, to two vertically spaced locations on said caisson, to tilt said caisson.

10. The method described in claim 9 wherein:

said step of applying forces includes moving said caisson with a set of mooring lines connected at a predetermined height to said caisson, and operating a thruster coupled to a caisson location that is vertically spaced from said predetermined height.

11. The method described in claim 9 wherein:

said step of applying forces includes mooring said caisson with a set of mooring lines that each extends at an incline and has an upper end coupled to said caisson at a first location and a lower end anchored to the seafloor, and extending each of a plurality of tension members from a second location on said caisson to a location on an upper portion of at least one of said mooring lines wherein said second location is below a corresponding first location of the corresponding mooring line;

when said caisson drifts, pulling on at least one said tension member to shorten its effective length and thereby tilt said caisson.

12. In a spar system that includes a tall but narrow caisson that is buoyant and that floats at the sea surface and that has upper and lower portions and a primarily vertical axis, and at least one riser pipe that extends up from the sea floor and that has a riser guided portion that is coupled to said caisson lower portion, with said riser pipe having an upper end connected to said caisson upper end portion, where said spar system includes a first set of mooring lines that have upper ends that are coupled to said caisson at first caisson locations with said mooring lines extending in different headings and at downward inclines to the sea floor and having lower ends anchored to the sea floor, and where said riser pipe extends substantially vertically from the sea floor to said caisson in a quiescent position of said caisson, the improvement of apparatus for minimizing bending of said riser pipes when said caisson drifts away from said quiescent position, comprising:

a second line having a proximal end coupled to said caisson at a second location that is vertically spaced from said first caisson locations with said second line having a distal end, means for holding said distal end to resist at least horizontal movement of said distal end, and a motor driven device coupled to said second line proximal end to pull said second line proximal end, to thereby enable controlled tilt of said caisson axis to reduce any angle between said caisson axis and a longitudinal axis of said riser pipe at a location immediately below said caisson.

13. The spar system described in claim 12 wherein:

said second line extends at an incline to the sea floor with said distal end fixed to the sea floor and said means for holding comprising an anchor.

14. The spar system described in claim 12 wherein:

said distal end of said second line is fixed to at least one of said mooring lines of said first set with said means for holding being formed by said at least one mooring line of said first set.

15. In a spar system that includes a tall but narrow caisson that is buoyant and that floats at the sea surface and that has upper and lower portions and a primarily vertical axis, and at least one riser pipe that extends up from the sea floor and that has a riser guided portion that is coupled to said caisson lower portion, with said riser pipe having an upper end connected to said caisson upper end portion, where said riser pipe extends substantially vertically from the sea floor to said caisson in a quiescent position of said caisson, the improvement of apparatus for minimizing bending of said riser pipe when said caisson drifts away from said quiescent position, comprising:

first and second sets of mooring lines that each extend at an incline and that have upper ends coupled to said caisson and lower ends anchored to the sea floor, with the upper ends of said first and second sets of lines being coupled to said caisson at first and second locations that are vertically spaced;

a motor driven device for changing the effective length of at least one mooring line of said sets of mooring lines, to thereby create a controlled tilt of said caisson axis that reduces any angle between said caisson axis and a longitudinal axis of said riser pipe at a location immediately below said caisson.

* * * * *